United States Patent [19]

Bachelor

[11] 4,124,842

[45] Nov. 7, 1978

[54] MORSE CODE SIGNALLING DEVICE

[76] Inventor: Robert Bachelor, 49 Thorncliffe Park Dr., Apt. 208, Toronto, Ontario, Canada

[21] Appl. No.: 648,175

[22] Filed: Jan. 12, 1976

[30] Foreign Application Priority Data

Jun. 13, 1975 [CA] Canada ..... 229320

[51] Int. Cl.[2] ..... G08B 5/38; H05B 41/26; H05B 41/34

[52] U.S. Cl. ..... 340/321; 250/199; 340/331; 340/345

[58] Field of Search ..... 340/331, 321, 345 R, 340/366 F, 378 R, 105; 325/116, 117, 111, 166; 250/199; 35/14

[56] References Cited

U.S. PATENT DOCUMENTS

| | | | |
|---|---|---|---|
| 3,205,487 | 9/1965 | Vriend | 340/321 |
| 3,614,528 | 10/1971 | Craddock | 340/105 |
| 3,668,684 | 6/1972 | Johnson | 340/321 |
| 3,764,849 | 10/1973 | Ohta | 315/241 P |
| 3,953,763 | 4/1976 | Herrick | 315/241 S |

*Primary Examiner*—Donald J. Yusko
*Assistant Examiner*—James J. Groody
*Attorney, Agent, or Firm*—Ridout & Maybee

[57] ABSTRACT

A portable signalling unit includes a gas discharge tube and a continuously cycling drive circuit which produces successive discharges through the tube, a control instrumentality being provided whereby the continuously cycling of the circuit may be overridden and brought under the control of a programming device which cause the discharges through the tube to follow a continuously repeating pattern. The pattern may represent the Morse code for SOS or any other desired signal.

2 Claims, 2 Drawing Figures

MORSE CODE SIGNALLING DEVICE

FIELD OF THE INVENTION

This invention relates to portable emergency signalling devices of the type comprising a battery operated flasher.

REVIEW OF THE PRIOR ART

It is known to provide battery operated flashlights and lanterns with the capability of providing a flashing emergency signal. The flashing signal is provided by an incandescent bulb controlled by or incorporating a thermally operated circuit interrupter, or driven by an electronic switch controlled by a suitable low frequency oscillator. Such arrangements have the disadvantage that the brightness of the flashing is limited, and with thermally operated devices the rate of flashing tends to vary and the commencement of flashing may be substantially delayed.

It is also known to provide battery operated photographic flashguns in which an intense flash of light is produced by discharging a capacitor through a xenon-filled discharge tube. A repeated brilliant flashing can also be produced by strobe units in which a capacitor is repeatedly charged, and then discharged through such a tube. It is in addition known to provide signals carried by beacons, buoys or vehicles which provide repeated flashes or sequence of flashes by rotating a suitably apertured shutter or reflector arrangement with or around a continuously illuminated electric light source which may be battery operated.

SUMMARY OF THE INVENTION

It is an object of the present invention to provide a portable battery operated emergency signalling device which is not only capable of providing repeated high intensity flashes of light, but is adapted to provide such flashes with a predetermined repeated sequence and spacing so as to transmit a recognisable signal such as the internationally recognized Morse code SOS signal. The means for providing the flashing sequence is preferably provided as an optional readily installed module without which the device will still operate to provide a continuous sequence of flashes. This facility both enables the basic device to be relatively cheap and also enables exchangeable modules to be used to provide different sequences of flashes.

According to the invention in one aspect, there is provided a battery operated signalling device, comprising a portable assembly comprising a battery, a battery casing enclosing the battery, a gas discharge tube, a capacitor connected across the discharge tube, a DC to DC converter connected to the battery and to the capacitor to charge the latter in a charge phase of a continuously repeating operating cycle, triggering means connected to the tube and operable to initiate discharge of the capacitor therethrough in a discharge phase of the operating cycle, means to actuate said triggering means and thus initiate the discharge phase a predetermined interval after the commencement of the charging cycle, and means selectively operable by an electrical signal to control the commencement of one of the charge phase and the discharge phase whereby optionally to override the normal repetition of the operating cycle and enable cycles to be controlled to occur according to a predetermined programme. A significant feature of the device is the selectively operable control means which enable the device either to provide repeating single flashes in an automatically repeating cycle, or to accept a control signal which may be used to provide a repeating programmed sequence of flashes, which can signal any desired message.

The control means may be operated in various ways, for example by controlling the supply of power to the DC to the DC converter, or by gating or switching an oscillator used to actuate the triggering means for the discharge tube. The control signal may be derived by suitable programming means either from the same oscillator used to actuate the triggering means in the normal repetitive mode of the device, or a separate oscillator. The programming means conveniently comprise a multistage counter chain and selection logic providing output signals corresponding to certain states of the counter. An output signal may also be provided to vary the frequency of the oscillator driving the counter so as to achieve a desired pattern of output signals, and more especially the necessary differentation between signals representing the dots and dashes of Morse code.

SHORT DESCRIPTION OF THE DRAWINGS

Further features of the invention will become apparent from the description of preferred embodiments of the invention with reference to the accompanying drawings, in which:

FIG. 1 is a longitudinal section of a signalling device in accordance with the invention, illustrating its physical construction, and FIG. 2 is a schematic diagram illustrating preferred forms of electrical construction of the device.

DESCRIPTION OF THE PREFERRED EMBODIMENTS

Figure 1:
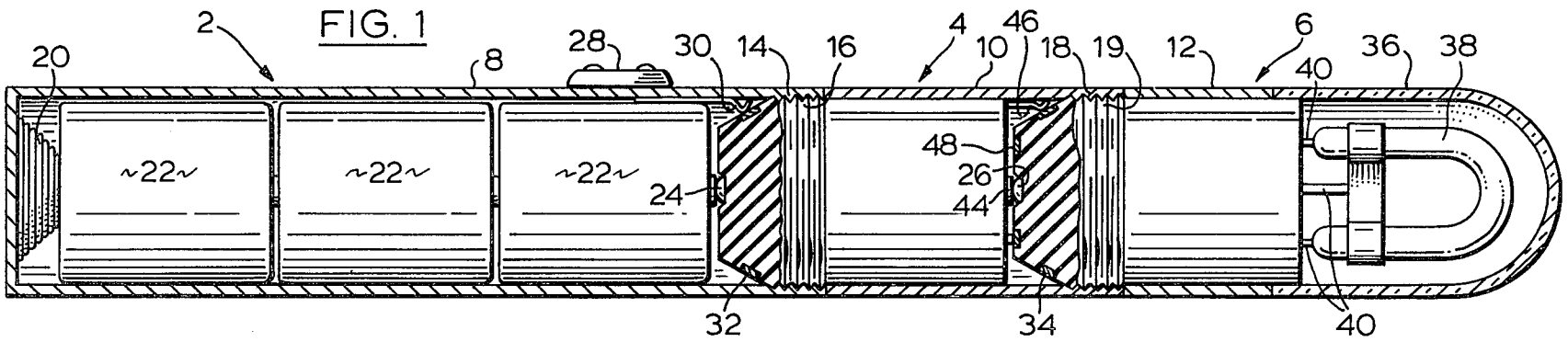

The device as shown in FIG. 1 comprises three basic modules, a battery module 2, a coding module 4, and a flash module 6. The modules have external cylindrical shells 8, 10 and 12 which are threaded so as to screw into one another to form a casing. The shell 8 of the battery module 2 has an internally threaded portion 14 at a top end; the shell 10 of the coding module has an externally threaded portion 16 at its bottom end engaging the portion 14, and an internally threaded portion 18 at its top end; and the shell 12 has an externally threaded portion 19 at its bottom end engaging the portion 16. As will be discussed below, the module 4 may be omitted, in which case the module 6 will screw directly into the module 2.

The module 2 is similar in construction to the body of a conventional flashlight, comprising the shell 8 which is closed at its lower end, a spring 20 which serves both to establish contact with the negative end of the lowest of three dry battery cells 22 and also to urge the cells upwardly so that the positive end of the uppermost cell presses against a contact 24 on the lower end of the module 4, or a contact 26 on the module 6 if the module 4 is omitted. A switch 28 is provided so as to make or break contact between the shell 8, which is of metal, and a spring contact 30, in a manner well understood in the flashlight art. The contact 30 presses against a contact ring 32 set in the base of the module 4 (or a ring 34 in the base of module 6.)

The module 6 has a transparent end dome 36, which may be colored if required, screwed to the remainder of the module and enclosing and protecting a xenon filled gas discharge tube 38 which has contact pins 40 plugged into a socket (not shown) in the module. The remainder of the module houses an electronic circuit powered by the cells 22 and comprising (see FIG. 2) a capacitor 42 and means repeatedly to charge the capacitor to a high voltage and to discharge it through the tube 38. The module 4 houses an electronic circuit adapted to control the repeated charge and discharge cycles of the capacitor 42 so that the flashes produced by the tube 38 form a definite repeating pattern or sequence rather than a continuous series. The module 4 has at its top end contacts 44 and 46 which engage the contact 26 and the contact ring 34, and a contact 48 which contacts a contact ring 50 on the module 6. In the module 4, the contact 44 is connected to the contact 24 and the contact 46 is connected to the contact ring 32. Thus connections are established between the modules 2 and 6 whether or not the module 4 is present. The contacts 48 and 50 permit control signals to be transferred from the module 4 to the module 6.

Figure 2:
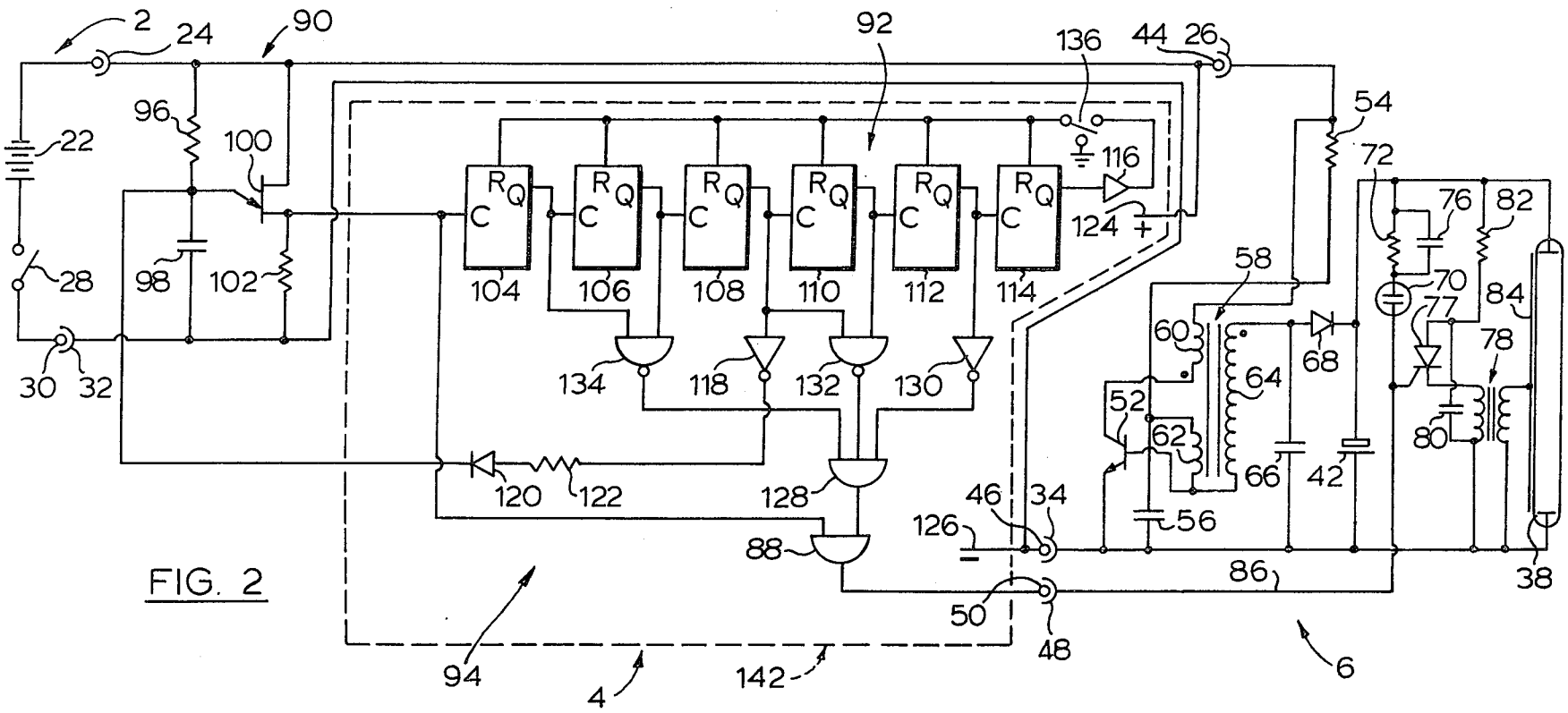

The electrical construction of the modules is shown in FIG. 2. The circuitry of the battery module 2 merely comprise the cells 22 and the switch 28 and has already been described.

The module 6 comprises firstly a DC-to-DC converter in which the 4.5 volts potential provided by the cells 22 (which will conveniently be size D 1.5 volt cells) is stepped up to a no-load potential of several hundred volts. The converter is formed by a conventional blocking oscillator comprised by a transistor 52, a resistor 54, a capacitor 56 and the primary and secondary windings 60 and 62 of a transformer 58. The operation of such oscillators is well understood and need not be explained. The oscillating current in the primary winding 60 induces a high alternating potential across the tertiary winding 64, which is tuned by the capacitor 66, and this potential is rectified by the diode 68 and used to charge the capacitor 42. The potential impressed on the capacitor 42 is applied across the ends of the discharge tube 38.

Disregarding for the moment the connection to the module 4 through the contact ring 50, the potential across the capacitor 42 is also applied across a miniature neon discharge tube 70 through a resistor 72.

The resistor 72 is of high value, typically about 3.3 megohms. When the potential across the capacitor 42 has risen to a sufficient level, the neon tube 70 will strike, permitting a capacitor 76 in parallel with the resistor 72 to discharge through the gate to cathode junction of a silicon controlled rectifier (SCR) 77 and the primary of a transformer 78. The passage of the resultant pulse of current causes turn-on of the SCR 77. This turn-on enables the capacitor 80, which is of larger value than the capacitor 76 and was previously charged through a high value resistor 82, to discharge also through the primary of the transformer 78, inducing a very high potential across its secondary, which potential is applied to a trigger electrode 84 on the discharge tube and initiates electrical breakdown of the gas within the tube. This breakdown results in the capacitor 42 discharging very rapidly through the tube and producing a brilliant flash of light. The various capacitors then commence to recharge and the operating cycle is repeated at a rate determined by the component values used. The actinic output of the tube 38 during each flash will depend on the value of the capacitor 42 and the potential to which it is charged, as determined by the frequency of the relaxation oscillator formed by the neon tube 70 in conjunction with the capacitor 42.

The above described mode of operation is valid when the module 4 is not present. When the module 4 is present, the gate of SCR 77 is connected via a control line 86 and the contacts 50 and 48 to the output of a gate 88 in the module 4, which gate has a low impedance of only a few hundred ohms and therefore represents an effective ground. Thus when the neon tube 70 strikes, the discharge from the capacitor 76 is dissipated, before the current through the primary of transformer 78 can rise to a level high enough to trigger the SCR. Triggering is delayed until the output of the gate 88 goes high, which results in a positive going pulse being delivered to the SCR gate through the control line 86, whereafter the discharge tube is triggered as described above. Provided that the intervals between successive occasions upon which the output of gate 88 goes high are sufficient to allow the capacitor 42 to recharge, the tube 38 will produce flashes on each of these occasions and not otherwise.

The form of the module 4 to be described produces a sequence of flashes representing the Morse code version of the international distress signal SOS. The module comprises a clock oscillator 90, a multistage ripple counter 92, and selection logic 94. The clock oscillator shown is a conventional unijunction transistor relaxation oscillator comprising a primary timing resistor 96 and a timing capacitor 98 connected between the emitter of an unijunction transistor 100 and the positive and negative supply lines respectively, and an output resistor 102 connected between the second base of the transistor and the negative supply, the first base being connected to the positive supply. A series of positive going pulses is developed across the resistor 102, the frequency of the pulses being set to about 1 Hz by suitable selection of the resistor 96 and the capacitor 98. The pulses are applied to one of the inputs of the AND gate 88 and to the input of the counter 92 which is formed by six T-type flip-flops 104, 106, 108, 110, 112 and 114 each having a toggle input T, an output Q and a reset input R. The output of flip-flop 114 is connected, if necessary via a buffer 116, to the reset inputs of all six flip flops so as to reset all six outputs to low at every thirty-second input pulse. The output of flip-flop 108 is connected via an inverter 118 and a diode 120 to one end of a secondary timing resistor 122 which is between half and one times the value of the primary timing resistor 96. This entails that when the output of the flip-flop 108 is low, the output of the inverter 118 is high and since the counter 92 and logic 94 are connected at 124 and 126 to the same supply as the oscillator 90, the resistor 122 is effectively in parallel with the resistor 96, thus increasing the frequency of the oscillator to between two and three times its original level. Thus the oscillator will deliver firstly four pulses at, say, half second intervals, then four pulses at, say, 1 second intervals, then four pulses at half second interval, and so on.

In order for these pulses to pass the gate 88, the second input of this gate must be high, entailing in turn that the output and all three inputs of an AND GATE 128 be high. One of these inputs is fed via an inverter 130 from the output of flip-flop 112 and therefore can only be high during the first sixteen of every group of 32 pulses entering the counter. The second of these inputs is fed from a NAND gate 132 having inputs connected to the outputs of flip-flops 108 and 110 and therefore can only be high when either or both of these latter outputs is low, i.e. during the first twelve pulses of each group of 16. The third input is fed from a NAND gate 134 having inputs connected to the outputs of flip-flops 104 and 106 and therefore can only be high when one or both of these latter inputs is low, i.e. during the first three pulses of every four. Thus of each group of 32 pulses, only the first to third, fifth to seventh, and ninth to eleventh pulses can pass the gate 88 and trigger flashes and the second four pulses of each eight are preceded by intervals of about 1 second as opposed to the intervals preceding the first four pulses, which are of about ½ second. The net result is that each group of thirty pulses produces from the tube 38 firstly three flashes separated by ½ second intervals, then a 1½ second gap, then three flashes separated by 1 second intervals, then a 1 ½ second gap, then three flashes separated by ½ second intervals, and then a 17 second gap before the cycle is repeated. Although the use of short duration flashes precludes the precise reproduction of conventional Morse code, the resulting signal provides an immediately recognizable simulation of the conventional Morse code SOS signal.

It will be appreciated that by the use of alternative logic 94, alternative forms of signal could be produced, either by the use of alternative modules 4 or by providing suitably programmable logic switchable so as to provide different signals. Conveniently, the counter 92 and logic 94 may be formed by conventional complementary MOS integrated circuits such as those sold by the Radio Corporation of America under the trade mark COSMOS and type numbers in the 4000 series. Thus in the example described, the counter 92 could be formed by a type 4024 seven bit ripple counter (the seventh stage not being used), the gates and inverters 118, 130, 132 and 134 by a type 4011 quadruple NAND gate, and the AND gates 88 and 128 by a triple three input AND gate from the same series, the gate 88 being formed by two gates connected in parallel so as to use up the third gate in the package and reduce its output impedance.

If it were not desired to use the signalling device without the module 4, then this could be integrated with the module 6, and the parts 70, 72 and 76 omitted. In this case, continuous repeated flashing of the tube 38 could be achieved merely by disabling the counter and using the oscillator 90 to replace the oscillator formed by the neon tube 70, for example by using a suitable switch 136 to connect the reset inputs of the flip-flops 104–114 to ground instead of to the buffer 116. In another alternative construction, the parts 70, 72 and 76 would be provided, but the contact 48 would not be connected to contact 50. Instead it could be connected to the S input of an S-R flip-flop of which the R input would be connected via the contact 50 to the gate of the SCR 77 or some other suitable point at which the triggering of the tube 38 will be indicated by an electrical pulse. The flip-flop would drive a transistor switch controlling the supply from the cells 22 to the DC to DC converter. In this instance, the counter 92 and logic 94 could be formed as a separate module incorporating the parts shown in FIG. 2 within the broken line 142 with the flip-flop being driven directly from the oscillator 90 which would then form part of the module 6.

In an alternative form of construction, the circuitry of the module 4 could form an optional internal part of the module 6, which would screw directly into the module 2.

One disadvantage of the arrangements described above which has been mentioned is that the simulation of Morse code is imperfect due to the very short duration of the flashes produced by the tube 38. One modification which overcomes this problem is possible. The oscillator 90 is modified to provide a square wave output, for example either by using a type of oscillator that will provide such an output, or by doubling the frequencies of the oscillator and passing its output through an additional T-type flip-flop. The control line 86 is connected to the base of an NPN transistor via an inverter, the gate of the SCR 77 being connected to the collector of the transistor instead of the line 86. The emitter of the transistor is grounded. The values of the components in the relaxation oscillator of which the neon tube 70 forms the heart are modified so the frequency of oscillation is much greater than that of the oscillator 90 instead of being of substantially the same order.

The result of this modification is that when the output of the gate 88 is low, the transistor is switched hard on, and the gate of SCR 77 is thus grounded, preventing triggering of the tube 38. When the output of the gate 88 goes high, the transistor is switched off, and the pulses from the neon oscillator trigger the SCR in the usual way. If the frequency of the neon oscillator is much higher than that of the oscillator 90, the tube will produce a series of rapid flashes each time the output of the gate goes high, and with a square wave oscillator driving the gate, the length of the flash sequences will change with the frequency of the oscillator to simulate the dots and dashes of Morse code. In order to reduce the gaps between successive dots or dashes, the mark-space ratio of the oscillator 90 (if changed to a square wave type) may be adjusted.

What I claim is:

1. A battery operated signalling device, comprising a portable assembly comprising a battery, a battery casing enclosing the battery, a gas discharge tube, a capacitor connected across the discharge tube, a DC to DC converter connected to the battery and to the capacitor to charge the latter in a charge phase of an operating cycle, triggering means connected to the tube and operable to initiate discharge of the capacitor therethrough in a discharge phase of the operating cycle, first means to actuate said triggering means and thus initiate the discharge phase a predetermined interval after the commencement of the charging phase so as to render the operating cycle continuously repetitive, said first actuating means comprising an oscillator providing actuating pulses for the triggering means, second means to actuate said triggering means and thus initiate the discharge phase, said second actuating means comprising electric pulse signal generating means programmed to generate pulse signals in a predetermined repeating sequence for application to said triggering means, and switch means connected selectively to enable either one of said first and second actuating means, the signal generating means comprising a programming device having a multi-stage counter and selection logic, the outputs of selected stages of the counter being connected to the inputs of the selection logic which is arranged to provide an output in response to selected states of the counter, the output of the selection logic being connected to the triggering means.

2. A device according to claim 1, wherein the selection logic provides a second output in response to different selected states of the counter, and this second output is applied to means controlling the output frequency of a further oscillator connected to the input of the counter.

* * * * *